US005826433A

United States Patent [19]

Dubé

[11] Patent Number: 5,826,433

[45] Date of Patent: Oct. 27, 1998

[54] REFRIGERATION SYSTEM WITH HEAT RECLAIM AND EFFICIENCY CONTROL MODULATING VALVE

[76] Inventor: Serge Dubé , 2595 Bourgogne, St. Lazare, Quebec, Canada, J0P 1V0

[21] Appl. No.: 824,146

[22] Filed: Mar. 25, 1997

[51] Int. Cl.[6] ..... F25B 41/00; F25B 27/00

[52] U.S. Cl. ..... 62/196.4; 62/238.6

[58] Field of Search ..... 62/117, 196.4, 62/238.6, DIG. 17

[56] References Cited

U.S. PATENT DOCUMENTS

| | | | |
|---|---|---|---|
| 4,286,437 | 9/1981 | Abraham et al. | 62/DIG. 17 |
| 4,437,317 | 3/1984 | Ibrahim | 62/196.4 |
| 4,535,603 | 8/1985 | Willitts et al. | 62/238.6 |
| 5,673,567 | 10/1997 | Dubé | 62/238.6 |

*Primary Examiner*—William E. Wayner
*Attorney, Agent, or Firm*—Swabey Ogilvy Renault; Guy J. Houle

[57] ABSTRACT

A high-efficiency refrigeration system (10) with total heat reclaim capacity comprises one or more compressors (11) for compressing a refrigerant gas to a desirable operating pressure. A bi-directional valve (14) communicates the compressed gas from the compressor (11) to condensers (19) for cooling the gas, when required, or to heat reclaim coils (21–23) to extract heat from the gas for heating air locally. A modulating valve (40) adjusts the pressure of the refrigerant gas at the compressors (11) and dependent on outside temperature. A refrigerant liquid/gas reservoir (28) receives liquid and vapor gas from the condensers (19) and the heat exchange coils (21–23) independently from one another whereby these liquid refrigerants will mix freely in the reservoir (28). A heat exchange coil (46) is connected between an outlet (45) of the refrigerant liquid/gas reservoir (28) and evaporators (48) whereby to cool liquid refrigerant gas from the reservoir to feed the evaporators. Expansion valves (50–55) are associated with the heat exchanger (46) to maintain the liquid refrigerant at an operating cool temperature.

10 Claims, 1 Drawing Sheet

REFRIGERATION SYSTEM WITH HEAT RECLAIM AND EFFICIENCY CONTROL MODULATING VALVE

TECHNICAL FIELD

The present invention relates to a high-efficiency refrigeration system with total heat reclaim and a modulating valve for controlling the pressure of the compressors and wherein a refrigerant gas reservoir is fed independently by the heat reclaim coils and condensers whereby liquid therefrom can flow to the reservoir and mix to achieve a reduction in refrigerant gas needs for the system.

BACKGROUND ART

In my co-pending U.S. Pat. No. 5,673,567, filed on Nov. 17, 1995, there is disclosed a total heat reclaim refrigeration system and wherein when outside ambient temperature falls below a certain temperature during winter months, the hot gases are recycled into heat reclaim coils which extract heat from the gases to add to the heating needs of the building in which the system is contained. The outlet pipes from the heat reclaim coils comprise a mixture of gas and liquid gas and these are connected back to the gas reservoir at a pressure of about 200 psi. Because the outlet of the condensers is also connected to the reservoir, and further because the temperature of the cooled gases in the condensors is at an inferior pressure to that of the cooling coils and namely at about 135 psi, a problem needs to be remedied because the liquid gas in the condenser cannot gravitate to the reservoir due to the higher pressure of the gases feeding the tank from the heat reclaim coils through the same inlet conduit of the tank. In order to compensate for this inefficiency when the heat reclaim coils are connected in the system, it is necessary to provide an increased amount of gas in the system to satisfy the requirements of the various component parts therein. Also, with such a system it is necessary to have a pressure controller at the outlet of the heat reclaim coils to control two solenoid valves whereby to direct the outlet gases and liquid of the heat reclaim coils to either the reservoir or back into the condensers for further cooling of the gas if the pressure of the gas is above 200 psi.

SUMMARY OF INVENTION

It is a feature of the present invention to overcome the above-mentioned deficiency in such a refrigeration system and to eliminate the controls and valves at the outlet of the heat reclaim coils and to also simplify the connection between the condensers and the reservoir.

It is another feature of the present invention to provide a high-efficiency refrigeration system with total heat reclaim and incorporating therein a modulating valve which automatically adjusts the pressure of the refrigerant gas by controlling the compressor head pressure and automatically re-directing a predetermined quantity of hot high pressure gas into the heat reclaim coils and dependent on outside temperature and the requirements of the heating system associated therewith.

Another feature of the present invention is to provide a high-efficiency refrigeration system with total heat reclaim and wherein the refrigerant gas reservoir is fed directly from the condenser as well as from the heat reclaim coils to receive without obstruction the liquid refrigerant therefrom for admixture and wherein the outlet of the reservoir is also provided with heat exchange means to feed a constant supply of cool refrigerant gas to the evaporators.

According to the above features, from a broad aspect, the present invention provides a high-efficiency refrigeration system with a total heat reclaim capacity. The system has a compressor means for compressing a refrigerant gas to a desirable operating pressure. A directional valve means is provided to communicate the compressed gas from the compressor to a condenser means for cooling the gas when required or to heat reclaim means to extract heat from the gas for heating air locally. A modulating valve is provided for adjusting the pressure of the refrigerant gas at the compressor means and dependent on outside temperature. A liquid/gas refrigerant reservoir is also provided and has a first inlet connected directly to an outlet conduit of the condenser means to receive liquid gas therefrom. The liquid/gas refrigerant reservoir has a second inlet connected directly to an outlet conduit of the heat reclaim means for receiving liquid refrigerant gas therefrom. Heat exchange means is connected between an outlet of the refrigerant gas reservoir and the evaporator means to cool liquid refrigerant gas from the reservoir to feed the evaporator means. An expansion valve is provided at an outlet of the heat exchanger to maintain the liquid refrigerant at an operating cool temperature. A gas by-pass line is provided from the outlet of the refrigerant gas reservoir to a gas inlet of the compressor. The expansion valve is provided with pressure sensing means for sensing the pressure of the gas in the by-pass line.

BRIEF DESCRIPTION OF DRAWINGS

A preferred embodiment of the present invention will now be described with reference to the accompanying drawing in which.

DESCRIPTION OF PREFERRED EMBODIMENTS

Figure 1:
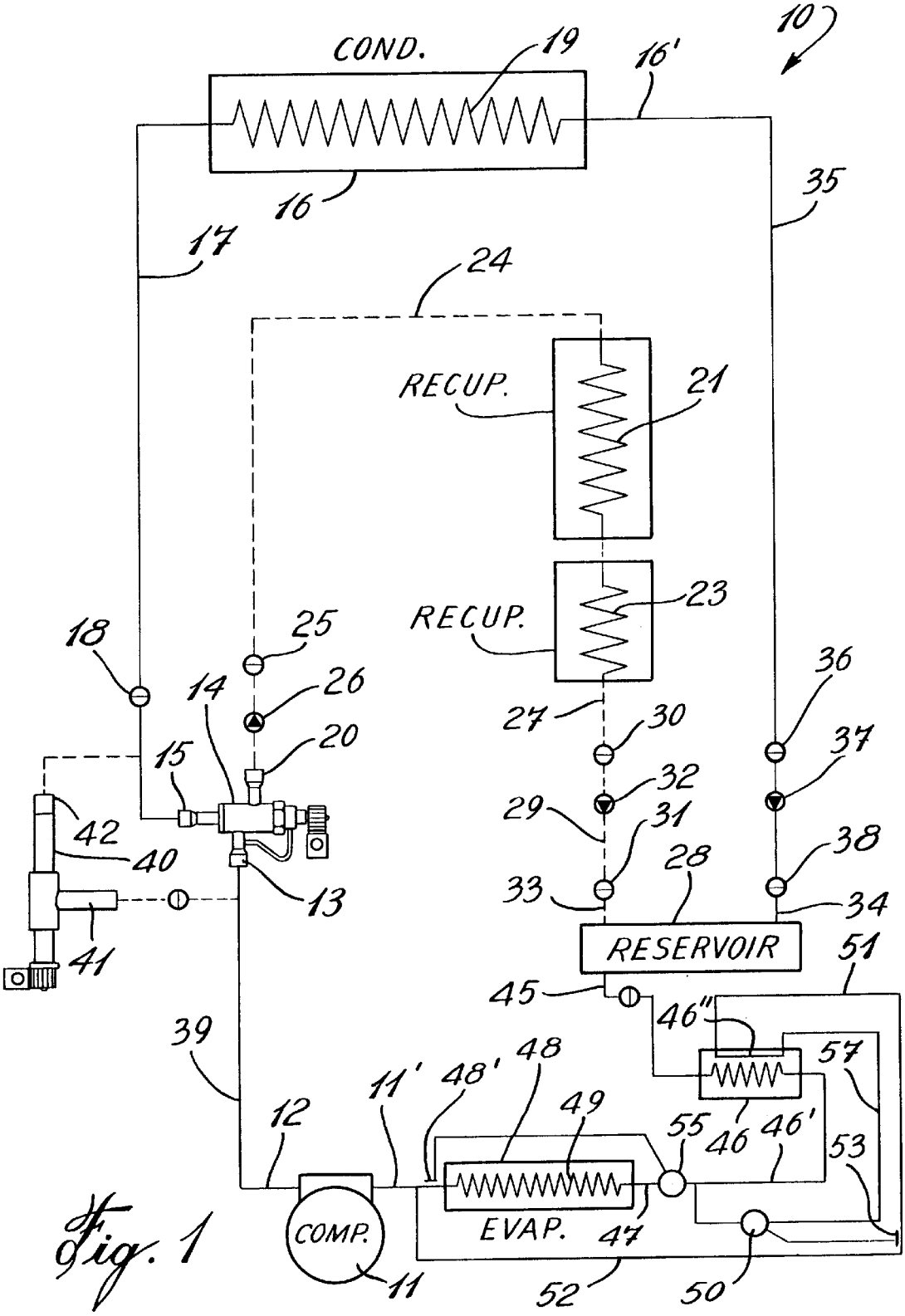
FIG. 1 is a schematic diagram illustrating the construction of the high-efficiency refrigeration system of the present invention.

Referring now to the drawings, and more particularly to FIG. 1, there is shown generally at 10 the improvement in a refrigeration system wherein to render it highly efficient. The description that follows is particularly directed to the improvement rather than to the detailed construction of the various component parts that one normally finds in a refrigeration system of the type, for example, as described in my aforesaid pending U.S. Pat. No. 5,673,567. As herein shown the high-efficiency refrigeration system 10 of the present invention comprises a compressor 11, herein schematically represented and which could consist of one or more compressors in a multi-evaporation coil system. The outlet 12 of the compressor 11 feeds a compressed refrigerant gas to an inlet port 13 of a three-port valve 14. The three-port valve 14 has a first outlet port 15 which is connected to a condenser 16 via conduit 17 provided with a ball valve 18 therein. The condenser 16 is herein schematically illustrated as comprising a single condenser coil 19 but as is obvious to a person skilled in the art, it may be comprised of a plurality of such condensor coils whereby to cool the liquid refrigerant flowing through the coil by heat exchange with the outside air. Usually, these condensor coils are mounted on rooftops.

The second outlet port 20 of the three-port valve 14 is connected to heat reclaim coils 21 and 22 through a conduit 24. A ball valve 25 and uni-directional valve 26 are connected in this conduit 24. Although only two heat reclaim coils 21 and 23 are herein shown, several of these may be connected in series. The outlet 27 of the last heat reclaim coil 23 is connected directly to a refrigerant liquid collection reservoir 28 through a conduit 29. Ball valves 30 and 31 as well as uni-directional check valve 32 are connected in this conduit 29. Accordingly, the refrigerant liquid and/or gas at the outlet of the heat reclaim coil, which has been cooled by these coils, is fed directly by gravity into the reservoir 28. There are no other pressure conduits connected to the outlet conduit 29 not to interfere with the gravitational flow of liquid refrigerant to the first inlet port 33 of the reservoir.

The reservoir 28 is also provided with a second inlet port 34 to receive in unobstructed flow therein the liquid and/or gas refrigerant from the outlet of the condenser 16. This gas is usually at a temperature of about 90° F. and flows by gravity within the conduit 35 directly into the reservoir 28 through the second inlet port. The conduit 35 is also provided with a ball valve 36 as well as a uni-directional check valve 37. Accordingly, it can be seen that the flow of pressurized refrigerant both from the outlet 16' of the condenser 16 as well as the outlet 27 of the last heat reclaim coil 23 are unconnected and therefore the differential pressure in these conduits have no effect upon the gas flow or the gravitational flow of the liquid within the conduits back into the reservoir where these liquids collect to be re-used.

The system as herein shown also includes a modulating valve 40 which is provided with a temperature sensor (43) to sense outside temperature and to modulate the flow of compressed refrigerant gas from the outlet of the compressor 11 through the three-port valve 14. Modulating valve 40 controls three-port valve 14 by modulating the flow through three-port valve 14. As herein shown the modulating valve 40 has an inlet port 41 which connects to the conduit 39 interconnecting the outlet 12 of the compressor to the inlet port 13 of the three-port valve 14. The modulating valve also has an outlet port 42 which connects to the conduit 17 at the outlet of the first outlet port 15 of the three-port valve. Accordingly, depending on outside temperature and the requirements of the refrigeration system, the modulating valve will by-pass some or all of the compressed refrigerant gas at the outlet of the compressor 12 to the condenser 16. If the system controller associated with the modulating valve in cold winter months requires that the building in which the system is located be heated due to cold outside temperature and the need for additional free heat, then the modulating valve will direct all or some of the compressed refrigerant gas at the outlet of the compressor 11 to the heat reclaim coils whereby to achieve up to 100 percent heat reclaim from the system. It can thus be appreciated that the modulating valve as well as the three-port valve provides a simple, economical and efficient control of the refrigerant gas. Also, all of the condensed gas at the outlets of the heat reclaim coils and/or condensers can be recovered in the reservoir 28 which is fed independently by the condensers as well as the heat reclaim coils and this prevents liquid refrigerant from being trapped in the circuit resulting in a reduction in the amount of refrigerant liquid requirements of the system.

In order to achieve still further efficiency the refrigerant liquid which is collected in the reservoir 28 is further cooled down by heat exchange means connected to the outlet port 45 of the reservoir 28. The heat exchange means is provided by a heat exchanger coil 46 through which a liquid refrigerant flows and is further cooled down to approximately 40° F. prior to being fed to the inlet 47 of the evaporator system 48. The outlet line 46' of the heat exchanger feeds two expansion valves 55 and 50. The expansion valve 55 changes the state of the refrigerant gas from liquid to vapor by feeding the gas mixture back through the heat exchanger 46 through line 57, and then back to the compressor through return line 51. The expansion valve 55 feeds the evaporator system 48 and its bulb 48' is connected to the outlet line 11 of the system 48 or inlet of the compressor. The pressure sensing bulb 53 of the expansion valve 50 monitors the pressure in the return line 51.

The evaporator system may be comprised of a plurality of evaporator coils 49 mounted in refrigeration coolers for cooling foodstuff displayed therein, as is well known in the art. The expansion valve 50 which is connected between the outlet line 46 of the heat exchanger 46 and the inlet line 57 of the feedback circuit 46" of the heat exchanger condensates gas flowing in admixture with the refrigerant liquid at the outlet of the heat exchanger.

It can therefore be appreciated that a refrigeration system incorporating the improvement as hereinabove described becomes highly efficient. With the modulating valve 40 the outside temperature is monitored and the pressure of the gas at the compressor 11 is adjusted. When the outside temperature is above 30° F., the modulating valve 40 opens whereby to lower the pressure at the outlet 12 of the compressor 11 thereby lowering the pressure at the compressor head and accordingly the compressor does not consume as much energy. There is also a lesser requirement for heat by the heat reclaim coils 21 and 23 when the temperature outside is not very cold. The modulating valve is provided with regulators whereby to set the various temperature requirements for proper operation of the system.

The modulating valve controller also has an ambient temperature sensing system whereby to modulate the temperature requirements of the ambient air inside the building where the system is mounted as well as the temperature requirements of the refrigeration apparatus associated therewith. The modulating valve 40 controls the refrigeration system during all seasons of the year. For example, during winter months, it is desirable that the compressor works at a higher pressure whereby to feed the heat reclaim coils in order to recover the maximum heat loss from the refrigerant gases. During spring and fall seasons, where the outside temperature is in the range of about 50° F., it is desirable to lower the pressure of the compressor whereby some of the gas will flow through the condensers to be cooled down and partly liquefied and recovered in the reservoir, and a part of the gas will flow through the heat reclaim coil to provide additional heat for the building. This lowers the energy consumption of a compressor as well as the energy consumption required to heat the building.

During summer months, or during the summer mode, the three-port valve 14 will shut off the refrigerant from the heat reclaim coils and only the condenser will be fed by the compressor whereby the hot gases are condensed by outside air. However, if the heat reclaim coils are incorporated into a hot water system, then water can be heated with this excess heat generated by the refrigerant gases.

With the present refrigeration system, the modulating valve requires very little adjustment as the only adjustment required is to adjust its temperature settings. The modulating valve maintains the compressor head temperature and accordingly the pressure in optimum operating ranges resulting in energy savings. Also, the cooled refrigerant liquid from the condensor as well as from the heat reclaim coils when utilized, feed the reservoir 28 independently and without obstruction. Accordingly, the refrigerant liquids from both the condensers as well as the heat reclaim coil will gravitate freely to the reservoir 28. The evaporators also achieve maximum efficiency.

It is within the ambit of the present invention to cover any obvious modifications of the preferred embodiment described herein, provided such modifications fall within the scope of the appended claims.

I claim:

1. A high-efficiency refrigeration system with total heat reclaim capacity, said system comprising compressor means for compressing a refrigerant gas to a desirable operating pressure, directional valve means to communicate said compressed gas from said compressor to a condenser means for cooling said gas when required or to heat reclaim means to extract heat from said gas for heating air locally, a modulating valve for adjusting the pressure of said refrigerant gas at said compressor means and dependent on outside temperature, a liquid/gas refrigerant reservoir having a first inlet connected directly to an outlet conduit of said condenser means to receive liquid refrigerant gas therefrom, said refrigerant gas reservoir having a second inlet connected directly to an outlet conduit of said heat reclaim means for receiving liquid refrigerant therefrom, and heat exchange means connected between an outlet of said liquid/gas refrigerant reservoir and said evaporator means to cool liquid refrigerant gas from said reservoir to feed said evaporator means, an expansion valve at an outlet of said heat exchanger to maintain said liquid refrigerant at an operating cool temperature, and a gas by-pass line from said outlet of said liquid/gas refrigerant reservoir to a gas inlet of said compressor, said expansion valve having pressure sensing means for sensing the pressure of said gas in said by-pass line.

2. A refrigeration system as claimed in claim 1 wherein said directional valve means is a three-port valve, said three-port valve being controlled by said modulating valve dependent on outside temperature to achieve maximum efficiency through lower energy consumption by said compressor means, heat reclaim and a reduction in refrigerant gas volume due to direct feed means to said liquid/gas refrigerant reservoir.

3. A refrigeration system as claimed in claim 2 wherein said direct feed means is comprised by said first and second inlets connected independently to said outlet conduit of said condenser means and said outlet conduit of said heat reclaim means whereby said liquid refrigerant therefrom can flow freely to said liquid/gas refrigerant reservoir regardless of the gas pressure at said outlet conduits.

4. A refrigeration system as claimed in claim 2 wherein said modulating valve has a controllable by-pass conduit to feed a controllable amount of refrigerant gas from said compressor means to said condenser means to thereby lower the pressure of said compressors to reduce energy consumption.

5. A refrigeration system as claimed in claim 4 wherein said compressor means is constituted by one or more refrigerant gas compressors.

6. A refrigeration system as claimed in claim 5 wherein said condenser means is constituted by one or more heat exchange cooling coils for cooling hot compressed gas from said compressors.

7. A refrigeration system as claimed in claim 3 wherein check valves and ball valves are connected in said outlet conduits from said condenser means and said heat reclaim means.

8. A refrigeration system as claimed in claim 2 wherein said heat reclaim means is comprised by one or more heat exchange coils for extracting heat from said compressed gas at said outlet of said compressor for heating another medium.

9. A refrigeration system as claimed in claim 8 wherein said another medium is air contained within a building in which said refrigeration system is used.

10. A refrigeration system as claimed in claim 2 wherein said evaporator means is constituted by a plurality of evaporator coils mounted in refrigerating devices for cooling foodstuff therein.

* * * * *